US009021796B2

(12) United States Patent
Uemura et al.

(10) Patent No.: US 9,021,796 B2
(45) Date of Patent: May 5, 2015

(54) PIPELAYER

(71) Applicant: Komatsu Ltd., Tokyo (JP)

(72) Inventors: Takuya Uemura, Hirakata (JP); Yasuhiko Takeuchi, Katano (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/114,963

(22) PCT Filed: May 20, 2013

(86) PCT No.: PCT/JP2013/063957
§ 371 (c)(1),
(2) Date: Oct. 31, 2013

(87) PCT Pub. No.: WO2014/188491
PCT Pub. Date: Nov. 27, 2014

(65) Prior Publication Data

US 2014/0338317 A1 Nov. 20, 2014

(51) Int. Cl.
*F16D 31/00* (2006.01)
*F15B 21/04* (2006.01)
*B66D 1/44* (2006.01)

(52) U.S. Cl.
CPC ..... *F15B 21/042* (2013.01); *F15B 2211/62* (2013.01); *B66D 1/44* (2013.01); *Y10S 60/905* (2013.01)

(58) Field of Classification Search
CPC .. F15B 21/045; F15B 21/042; F15B 2211/66; F15B 2211/62; B66D 1/44
USPC ..... 60/329, 456, 905; 242/390.6, 414; 91/419, 431
See application file for complete search history.

(56) References Cited

U.S. PATENT DOCUMENTS 3,815,478 A * 6/1974 Axelsson et al. ..... 91/497
3,969,897 A * 7/1976 Humphreys et al. ..... 60/456
3,972,185 A * 8/1976 Medina ..... 60/421
4,048,799 A * 9/1977 Golan et al. ..... 60/413
(Continued)

FOREIGN PATENT DOCUMENTS

JP 10-274212 A 10/1998
JP 11-108015 A 4/1999
(Continued)

OTHER PUBLICATIONS

International Search Report for PCT/JP2013/063957, issued on Aug. 20, 2013.

*Primary Examiner* — Edward Look
*Assistant Examiner* — Michael Quandt
(74) *Attorney, Agent, or Firm* — Global IP Counselors, LLP

(57) ABSTRACT

A pipelayer includes a pilot pressure control unit. The pilot pressure control unit supplies hydraulic fluid to a pilot port of a warm-up control valve so that the warm-up control valve enters an open state when a winch control valve is in the closed state. The pilot pressure control unit drains hydraulic fluid from the pilot port of the warm-up control valve so that the warm-up control valve enters the closed state when the winch control valve is in the open state. The stroke amount from the stroke end of the closed side of the spool of the warm-up control valve when the meter-out opening of the warm-up control valve is fully closed is larger than the stroke amount from the stroke end of the closed side of the spool of the winch control valve when the meter-in opening of the winch control valve is fully closed.

8 Claims, 6 Drawing Sheets

(56) References Cited

U.S. PATENT DOCUMENTS

| | | | | | |
|---|---|---|---|---|---|
| 4,354,351 | A | * | 10/1982 | Dezelan | 60/456 |
| 4,972,762 | A | * | 11/1990 | Kubik | 91/461 |
| 5,735,506 | A | * | 4/1998 | Warnan et al. | 254/361 |
| 7,591,214 | B2 | * | 9/2009 | Ando et al. | 91/431 |
| 8,234,860 | B2 | * | 8/2012 | Beschorner et al. | 60/329 |
| 2013/0026431 | A1 | | 1/2013 | Uemura et al. | |

FOREIGN PATENT DOCUMENTS

| | | | |
|---|---|---|---|
| JP | 2000-74011 | A | 3/2000 |
| JP | 2003-239907 | A | 8/2003 |
| WO | 2012/086695 | A1 | 6/2012 |

* cited by examiner

PIPELAYER

CROSS-REFERENCE TO RELATED APPLICATIONS

This application is a U.S. National stage application of International Application No. PCT/JP2013/063957, filed on May 20, 2013.

BACKGROUND

1. Field of the Invention

The present invention relates to a pipelayer.

2. Background Information

A pipelayer is a work vehicle used for installing pipes at petroleum and natural gas delivery pipeline construction sites and the like. For example, at a pipeline construction site, multiple pipelayers are lined up in a row and the pipelayers hoist a wire using a winch to lift up the pipes. The winch is connected to a hydraulic motor and rotated by hydraulic pressure.

Warming up is performed to raise the temperature of the hydraulic fluid in the pipelayer. For example, a pipelayer described in International Publication WO 2012-086695 has a pump hydraulic circuit connected to a hydraulic pump, a drive hydraulic circuit through which the hydraulic fluid for driving the hydraulic motor passes, and a warm-up hydraulic circuit through which the hydraulic fluid for warming up the hydraulic motor passes. A winch control valve is disposed between the pump hydraulic circuit and the drive hydraulic circuit. A warm-up control valve is disposed between the pump hydraulic circuit and the warm-up hydraulic circuit.

SUMMARY

Hydraulic fluid is drained from a pilot port of the winch control valve in the abovementioned pipelayer when the winch is stopped. As a result, the winch control valve enters a closed state and the hydraulic motor is stopped. Furthermore, hydraulic fluid is supplied to the pilot port of the warm-up control valve. As a result, the warm-up control valve enters an open state, hydraulic fluid is supplied to the warm-up hydraulic circuit, and the hydraulic motor is warmed up.

Hydraulic fluid is supplied to the pilot port of the winch control valve while the winch is being driven. As a result, the winch control valve enters an open state and the hydraulic motor is driven. Furthermore, hydraulic fluid is drained from the pilot port of the warm-up control valve. As a result, the warm-up control valve enters a closed state and the warm-up of the hydraulic motor is stopped. According to this configuration, simultaneous operation of driving and warming up of the hydraulic motor is prevented.

However, the pipelayer may be used in extremely cold environments where the temperature falls below −40 C.°. Draining of the hydraulic fluid from the pilot ports of the control valves may be delayed in such an extremely cold environment due to the lower temperature of the hydraulic fluid. In particular, when the draining of the hydraulic fluid from the pilot port of the warm-up control valve is delayed while the winch is being driven, the switching of the warm-up control valve to the closed state is also delayed. In this case, both the warm-up control valve and the winch control valve enter closed states which may lead to an excessive load on the hydraulic circuits.

An object of the present invention is to provide a pipelayer that is capable of avoiding in a stable manner the simultaneous operation of driving and warming up the winch even in an extremely cold environment.

A pipelayer according to an aspect of the present invention is provided with an engine, a hydraulic pump, a hydraulic motor, a winch, a pump hydraulic circuit, a drive hydraulic circuit, a warm-up hydraulic circuit, a winch control valve, a warm-up control valve, and a pilot pressure control unit. The hydraulic pump is driven by the engine. The hydraulic motor is driven by hydraulic fluid discharged from the hydraulic pump. The winch is driven by the hydraulic motor. The pump hydraulic circuit is connected to the hydraulic pump. Hydraulic fluid discharged from the hydraulic pump passes through the pump hydraulic circuit. The drive hydraulic circuit is connected to the hydraulic motor. Hydraulic fluid for driving the hydraulic motor passes through the drive hydraulic circuit. The warm-up hydraulic circuit is connected to the hydraulic motor. Hydraulic fluid for warming up the hydraulic motor passes through the warm-up hydraulic circuit.

The winch control valve is provided between the pump hydraulic circuit and the drive hydraulic circuit. The winch control valve allows communication between the pump hydraulic circuit and the drive hydraulic circuit in an open state, and shuts off communication between the pump hydraulic circuit and the drive hydraulic circuit in a closed state. The warm-up control valve is provided between the pump hydraulic circuit and the warm-up hydraulic circuit. The warm-up control valve allows communication between the pump hydraulic circuit and the warm-up hydraulic circuit in an open state, and shuts off communication between the pump hydraulic circuit and the warm-up hydraulic circuit in a closed state.

The pilot pressure control unit supplies hydraulic fluid to the pilot port of the warm-up control valve so that the warm-up control valve enters the open state when the winch control valve is in the closed state. The pilot pressure control unit drains hydraulic fluid from the pilot port of the warm-up control valve so that the warm-up control valve enters the closed state when the winch control valve is in the open state.

The stroke amount from the stroke end of the closed side of the spool of the warm-up control valve when the meter-out opening of the warm-up control valve becomes fully closed is larger than the stroke amount from the stroke end of the closed side of the spool of the winch control valve when the meter-in opening of the winch control valve becomes fully closed.

In other words, the stroke amount from when the meter-out opening of the warm-up control valve is fully open until the same is fully closed is smaller than the stroke amount from when the meter-in opening of the winch control valve is fully open until the same is fully closed. Therefore, the stroke amount from when the meter-out opening of the warm-up control valve is fully open until the same is fully closed is small in comparison to when the warm-up control valve meter-out opening characteristics are set to be the same as the winch control valve meter-in opening characteristics. As a result, even if the hydraulic fluid drained from the pilot port of the warm-up control valve has a low temperature, the warm-up control valve meter-out opening can quickly become fully closed. As a result, the time period in which both the warm-up control valve and the winch control valve are in the open state can be reduced or eliminated. Consequently, the simultaneous operation of driving and warming up the winch even in an extremely cold environment can be avoided in a stable manner.

The stroke position of the spool of the winch control valve when the meter-in opening of the winch control valve becomes fully closed is preferably nearer the stroke end of the closed side than the stroke end of the open side of the winch control valve. The stroke position of the spool of the warm-up control valve when the meter-out opening of the warm-up control valve is fully closed is preferably nearer the stroke end of the open side than the stroke end of the closed side of the warm-up control valve.

In this case, the stroke amount from when the meter-out opening of the warm-up control valve is fully open until the same is fully closed is small in comparison to when the warm-up control valve meter-out opening characteristics are set to be the same as the winch control valve meter-in opening characteristics. As a result, even if the hydraulic fluid drained from the pilot port of the warm-up control valve has a low temperature, the warm-up control valve meter-out opening can quickly become fully closed. As a result, the time period in which both the warm-up control valve and the winch control valve are in the open state can be reduced or eliminated. Consequently, the simultaneous operation of driving and warming up the winch even in an extremely cold environment can be avoided in a stable manner.

The surface area of the warm-up control valve meter-out opening is preferably maximized when the stroke position of the warm-up control valve spool reaches the stroke end of the open side. In this case, the warm-up control valve meter-out opening begins to close immediately after the warm-up control valve spool starts to move from the stroke end of the open side. As a result, the warm-up control valve can become fully closed more quickly.

The warm-up control valve meter-out opening characteristics that indicate the surface area of the meter-out opening with respect to the stroke amount of the warm-up control valve spool preferably have an inflection point. In this case, the warm-up control valve is able to switch from fully open to fully closed in a shorter stroke amount in comparison to when there is no inflection point.

According to the present invention, a pipelayer is provided that is capable of avoiding in a stable manner the simultaneous operation of driving and warming up the winch even in an extremely cold environment.

DETAILED DESCRIPTION OF EMBODIMENTS

Figure 1:
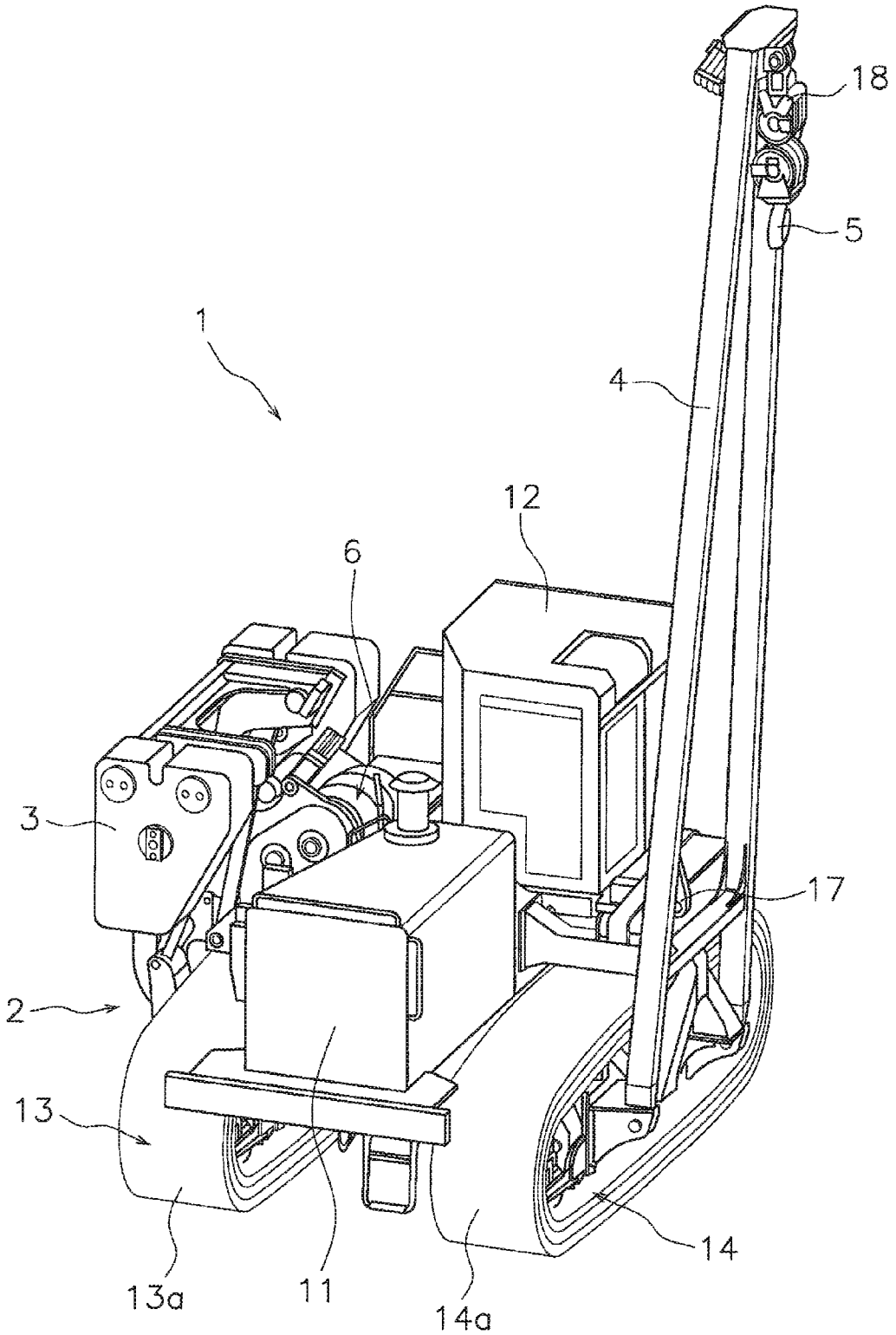
FIG. 1 is a perspective view of a pipelayer.

A pipelayer 1 according to the first embodiment of the present invention is illustrated in FIG. 1. FIG. 1 is a perspective view illustrating the appearance of the pipelayer 1. The pipelayer 1 includes a vehicle body 2, a counterweight 3, a boom 4, a hook 5, and a winch device 6. A belowmentioned wire 102 for the boom 4 and a wire 101 for the hook 5 are omitted in FIG. 1 to make the drawing easier to understand.

The vehicle body 2 includes an engine compartment 11, a cab 12, and a pair of travel devices 13 and 14. A belowmentioned engine is provided in the engine compartment 11. The cab 12 and other devices such as a hydraulic pump (see FIG. 3) are provided behind the engine compartment 11. The travel devices 13 and 14 include crawler belts 13*a* and 14*a*. The pipelayer 1 travels due to the crawler belts 13*a* and 14*a* being driven by a driving force from the engine.

Figure 2:
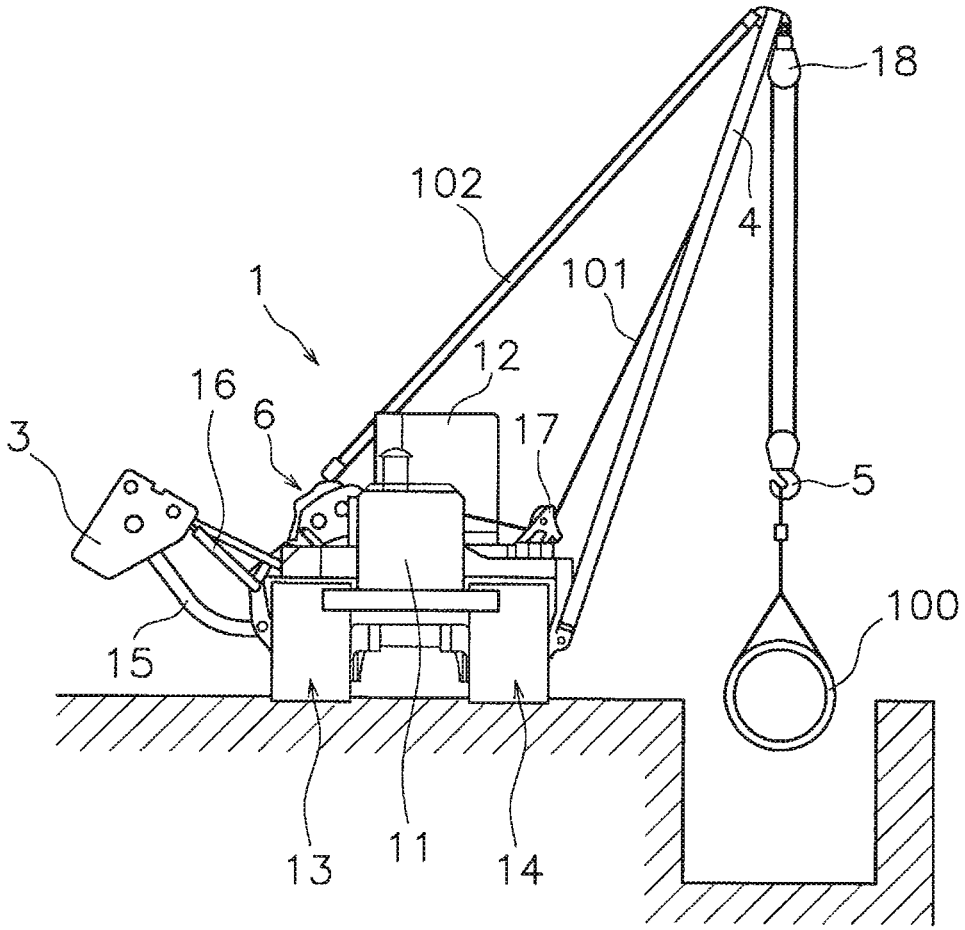
FIG. 2 is an elevation showing a working state of a pipelayer.

The counterweight 3 is mounted on one side of the vehicle body 2. FIG. 2 is an elevation illustrating a state in which the pipelayer 1 is conducting installation work of a pipe 100. The counterweight 3 is mounted on the vehicle body 2 via an arm member 15. The counterweight 3 is provided in a moveable manner with a hydraulic cylinder 16. The pipelayer 1 can maintain balance of the body by adjusting the distance of the counterweight 3 from the vehicle body 2.

The boom 4 is mounted on another side of the vehicle body 2. Specifically, the boom 4 is mounted on the side of the vehicle body 2 that is opposite the side on which the counterweight 3 is mounted. The bottom of the boom 4 is mounted in a swingable manner with respect to the vehicle body 2. A first pulley 18 is provided at the top of the boom 4. The first pulley 18 supports the wire 101 intercoupled with the hook 5. A second pulley 17 is provided on a top surface of lateral portion on the vehicle body 2 at the boom 4 side thereof. The wire 101 intercoupled with the hook 5 stretches through the first pulley 18 and the second pulley 17 to a winch, which is not illustrated, for the hook 5. The belowmentioned wire 102 for the boom 4 that stretches from the winch for the boom 4 is intercoupled to a top portion of the boom 4.

Figure 3:
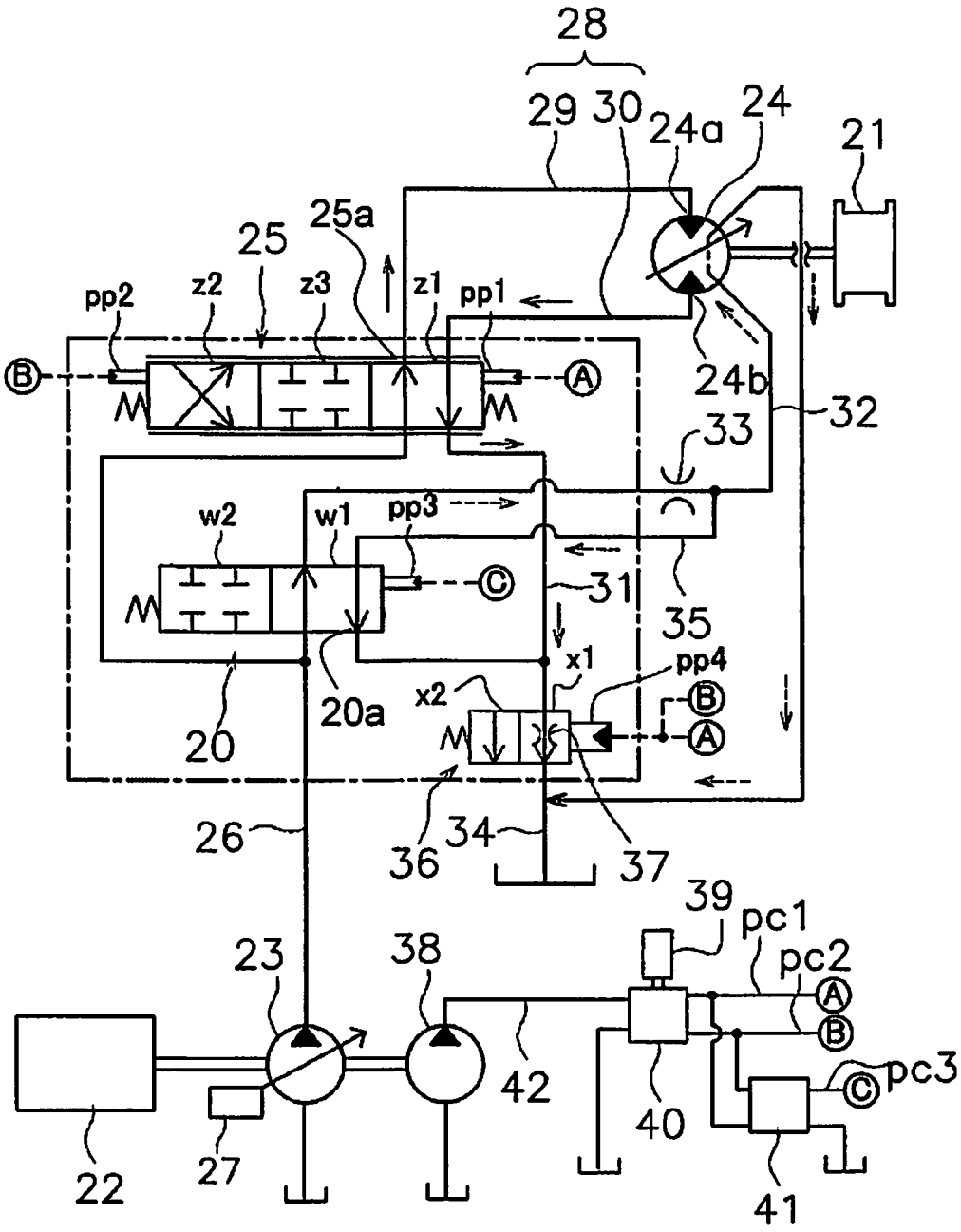
FIG. 3 is a schematic view showing a hydraulic circuit included in a pipelayer.

FIG. 3 is a schematic view illustrating a hydraulic drive system for driving the boom 4. The pipelayer 1 includes a winch 21 for the boom 4 as illustrated in FIG. 3.

The winch 21 is provided on the abovementioned winch device 6. The wire 102 is wound onto the winch 21. The boom 4 is able to swing up and down due to the winding up or winding down of the wire 102 by the winch 21. Similarly, the hook 5 illustrated in FIGS. 1 and 2 is hoisted and lowered due to the winding up or winding down of the wire 101 by the winch, which is not illustrated, for the hook 5.

The pipelayer 1 includes an engine 22, a first hydraulic pump 23, a hydraulic motor 24, a winch control valve 25, and a warm-up control valve 20.

The engine 22 is a diesel engine, for example, and the output of the engine 22 is controlled by adjusting the injection amount of fuel from a fuel injection pump which is not illustrated. Adjusting the fuel injection amount is conducted by controlling with a mechanical governor provided on the fuel injection pump. Generally, a governor of an all-speed control system is used as the mechanical governor so that the engine rotation speed and the fuel injection amount are adjusted according to a load by a centrifugal action. Specifically, the governor increases and decreases the fuel injection amount by displacing a pair of centrifugal weights attached to a rotating shaft coupled to an output shaft of the engine 22.

The first hydraulic pump 23 is driven by the engine 22 to discharge hydraulic fluid. A first pump hydraulic circuit 26 is connected to the first hydraulic pump 23. The first pump hydraulic circuit 26 is a hydraulic circuit through which passes hydraulic fluid discharged from the first hydraulic pump 23. The first hydraulic pump 23 is a variable displacement hydraulic pump. The capacity of the first hydraulic pump 23 is controlled by a pump volume adjusting unit 27.

The hydraulic motor 24 is driven by hydraulic fluid from the first hydraulic pump 23. The hydraulic motor 24 drives the winch 21. A drive hydraulic circuit 28 is connected to the hydraulic motor 24. The drive hydraulic circuit 28 is a hydraulic circuit through which passes hydraulic fluid for driving the hydraulic motor 24. The drive hydraulic circuit 28 includes a first drive hydraulic circuit 29 and a second drive hydraulic circuit 30. The first drive hydraulic circuit 29 is connected to a first motor port 24*a* of the hydraulic motor 24. The second drive hydraulic circuit 30 is connected to a second motor port 24*b* of the hydraulic motor 24.

The hydraulic motor 24 is driven in one direction (e.g., the hoisting direction of the winch 21) due to the hydraulic fluid being discharged from the second motor port 24*b* and supplied to the first motor port 24*a*. The hydraulic motor 24 is driven in another direction (e.g., the lowering direction of the winch 21) due to the hydraulic fluid being discharged from the first motor port 24*a* and supplied to the second motor port 24*b*.

The winch control valve 25 is provided between the first pump hydraulic circuit 26 and the drive hydraulic circuit 28. The winch control valve 25 is connected to a drive drain circuit 31. The winch control valve 25 is a pressure proportional control valve and adjusts the flow rate of the hydraulic fluid fed from the first pump hydraulic circuit 26 to the drive hydraulic circuit 28 in response to pilot pressures inputted into pilot ports pp1 and pp2. The winch control valve 25 is switched between states z1, z2, and z3 in response to pilot pressures inputted into the pilot ports pp1 and pp2.

Specifically, the winch control valve 25 enters the state z1 due to the hydraulic fluid being supplied to the pilot port pp1. The winch control valve 25 enters the state z2 due to the hydraulic fluid being supplied to the pilot port pp2. The winch control valve 25 enters the state z3 due to the hydraulic fluid being drained from the pilot ports pp1 and pp2.

Communication between the first pump hydraulic circuit 26 and the first drive hydraulic circuit 29 and communication between the second drive hydraulic circuit 30 and the drive drain circuit 31 are enabled when the winch control valve 25 is in the state z1. Communication between the first pump hydraulic circuit 26 and the second drive hydraulic circuit 30 and communication between the first drive hydraulic circuit 29 and the drive drain circuit 31 are enabled when the winch control valve 25 is in the state z2. The first drive hydraulic circuit 29 and the second drive hydraulic circuit 30 are shut off from the first pump hydraulic circuit 26 when the winch control valve 25 is in the state z3.

The warm-up control valve 20 is provided between the first pump hydraulic circuit 26 and the warm-up hydraulic circuit 32. The warm-up hydraulic circuit 32 is a hydraulic circuit through which hydraulic fluid for warming up the hydraulic motor 24 passes, and is provided with a throttle 33 as a pressure loss portion. The hydraulic fluid flowing through the warm-up hydraulic circuit 32 becomes heated by passing through the throttle 33. The warm-up hydraulic circuit 32 passes through the inside of the hydraulic motor 24 and is connected to a tank circuit 34. The tank circuit 34 is connected to a hydraulic fluid tank which is not illustrated.

The warm-up control valve 20 is a hydraulic directional control valve and is switched between an open state w1 and a closed state w2 in response to a pilot pressure inputted into a pilot port pp3. Specifically, the warm-up control valve 20 enters the open state w1 due to the hydraulic fluid being supplied to the pilot port pp3. The warm-up control valve 20 enters the closed state w2 due to the hydraulic fluid being drained from the pilot port pp3. Communication between the first pump hydraulic circuit 26 and the warm-up hydraulic circuit 32 and communication between a warm-up drain circuit 35 and a drive drain circuit 31 are enabled when the warm-up control valve 20 is in the open state w1. The warm-up drain circuit 35 is connected to the warm-up hydraulic circuit 32 between the throttle 33 and the hydraulic motor 24. Communication between the first pump hydraulic circuit 26 and the warm-up hydraulic circuit 32 and communication between the warm-up drain circuit 35 and the drive drain circuit 31 are shut off when the warm-up control valve 20 is in the closed state w2.

The drive drain circuit 31 is connected to the tank circuit 34 via a back pressure valve 36. The back pressure valve 36 is a hydraulic control valve and is switched between a state x1 and a state x2 in response to a pilot pressure inputted into a pilot port pp4. Specifically, the back pressure valve 36 enters the state x1 due to the hydraulic fluid being supplied to the pilot port pp4. The back pressure valve 36 enters the state x2 due to the hydraulic fluid being drained from the pilot port pp4. The drive drain circuit 31 and the tank circuit 34 are connected via a throttle 37 when the back pressure valve 36 is in the state x1. The drive drain circuit 31 and the tank circuit 34 are connected without passing through the throttle 37 when the back pressure valve 36 is in the state x2.

The pipelayer 1 includes a second hydraulic pump 38, a winch operating member 39, a drive pilot pressure control unit 40, and a warm-up pilot pressure control unit 41.

The second hydraulic pump 38 is driven by the engine 22 to discharge hydraulic fluid. The second hydraulic pump 38 is connected to the second pump hydraulic circuit 42. The second pump hydraulic circuit 42 is a hydraulic circuit through which the hydraulic fluid discharged from the second hydraulic pump 38 passes. The second hydraulic pump 38 is a fixed displacement hydraulic pump.

The winch operating member 39 is provided in the operator's cab 12 and is a member for the operator to operate the winch 21. The winch operating member 39 is, for example, a lever. The winch operating member 39 can be operated at a hoisted position, a lowered operating position, and a center position.

The drive pilot pressure control unit 40 adjusts the pilot pressure inputted into the pilot ports pp1 and pp2 of the winch control valve 25 in response to operation of the winch operating member 39. The drive pilot pressure control unit 40 is disposed between the second pump hydraulic circuit 42 and pilot pressure circuits pc1 and pc2. The pilot pressure circuit pc1 is connected to the pilot port pp1 of the winch control valve 25. The pilot pressure circuit pc2 is connected to the pilot port pp2 of the winch control valve 25.

When the winch operating member 39 is moved to the hoisted position, the drive pilot pressure control unit 40 supplies hydraulic fluid to the pilot port pp1 of the winch control valve 25 via the pilot pressure circuit pc1. When the winch operating member 39 is moved to the lowered position, the drive pilot pressure control unit 40 supplies hydraulic fluid to the pilot port pp2 of the winch control valve 25 via the pilot pressure circuit pc2. As a result, the winch 21 is driven due to the winch control valve 25 being set in the state z1 or the state z2 so that hydraulic fluid is supplied to the hydraulic motor 24.

When the winch operating member 39 is positioned in the center position, hydraulic fluid is drained from either of the pilot ports pp1 or pp2 of the winch control valve 25. Consequently, the hydraulic motor 24 is not driven and a brake, which is not shown, is applied and the winch 21 enters a stopped state.

When the winch operating member 39 is moved to the hoisted position or the lowered position, the drive pilot pressure control unit 40 supplies hydraulic fluid to the pilot port pp4 of the back pressure valve 36. As a result, back pressure is generated in the drive drain circuit 31 while the winch 21 operates. When the winch operating member 39 is moved to the center position, the drive pilot pressure control unit 40 drains the hydraulic fluid from the pilot port pp4 of the back pressure valve 36.

The warm-up pilot pressure control unit 41 adjusts the pilot pressure inputted into the pilot port pp3 of the warm-up control valve 20 in response to operation of the winch operating member 39. The warm-up pilot pressure control unit 41 is disposed between the pilot pressure circuits pc1, pc2 and a pilot pressure circuit pc3. The pilot pressure circuit pc3 is connected to the pilot port pp3 of the warm-up control valve 20.

When the winch operating member 39 is moved to the hoisted position or the lowered position, the warm-up pilot pressure control unit 41 drains the hydraulic fluid from the pilot port pp3 of the warm-up control valve 20. As a result, the closed state w2 of the warm-up control valve 20 is set. Hydraulic fluid is not supplied to the warm-up hydraulic circuit 32 and warming up is not performed. Specifically, the warm-up pilot pressure control unit 41 drains the hydraulic fluid from the pilot port pp3 of the warm-up control valve 20 so that the warm-up control valve 20 enters the closed state w2 while the winch control valve 25 is in the open state z1 or z2. As a result, warming up while the winch 21 is operating is prevented.

When the winch operating member 39 is moved to the center position, the warm-up pilot pressure control unit 41 supplies hydraulic fluid to the pilot port pp3 of the warm-up control valve 20 via the pilot circuit pc3. Therefore, the warm-up pilot pressure control unit 41 supplies hydraulic fluid to the pilot ports of the warm-up control valve 20 so that the warm-up control valve 20 enters the open state w1 when the winch control valve 25 is in the closed state z3. As a result, warming up while the winch 21 is stopped is performed.

Figure 4:
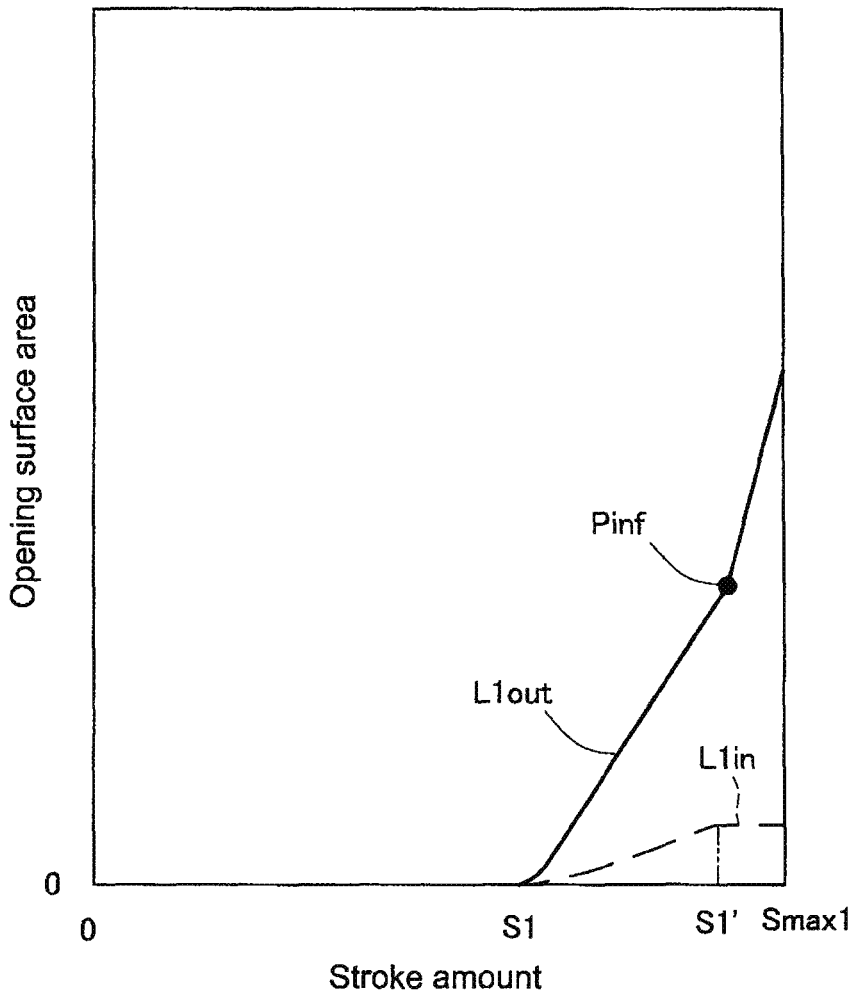
FIG. 4 illustrates opening characteristics of a warm-up control valve.
Figure 5:
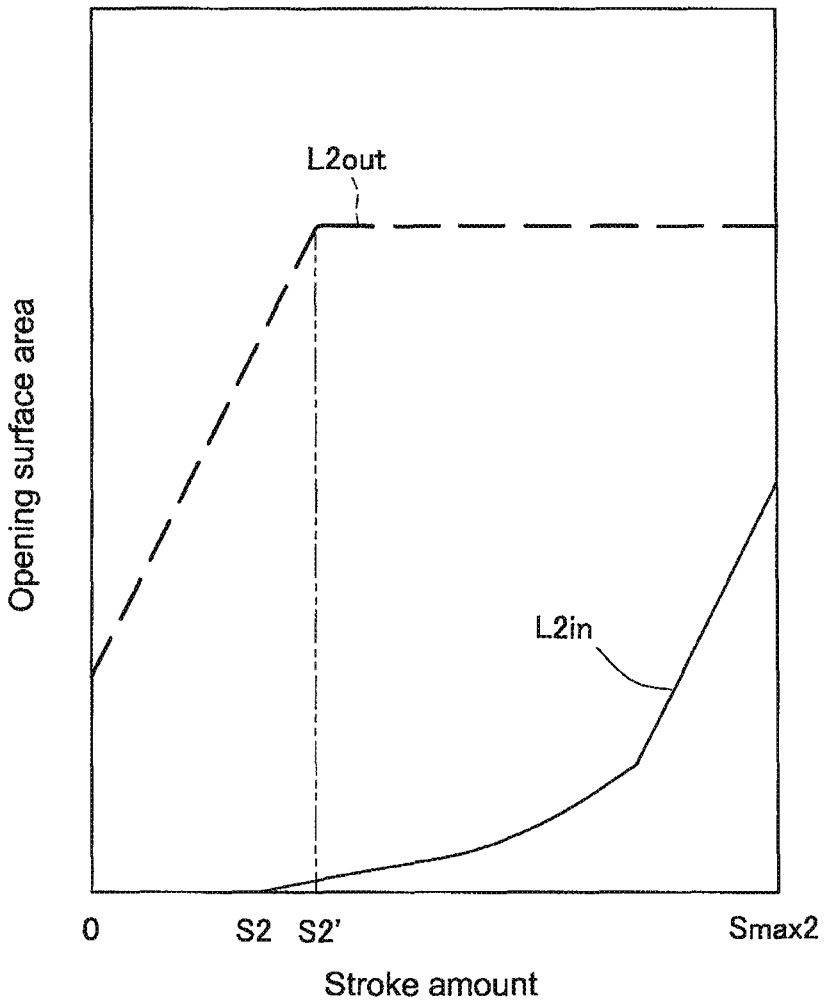
FIG. 5 illustrates opening characteristics of a winch control valve.

The following is an explanation of the opening characteristics of the warm-up control valve 20 and the winch control valve 25. FIG. 4 illustrates the opening characteristics of the warm-up control valve 20. The solid line L1out in FIG. 4 represents the relationship between the meter-out opening surface area and the stroke amount of the warm-up control valve 20. The dashed line L1in represents the relationship between the meter-in opening surface area and the stroke amount of the warm-up control valve 20. FIG. 5 illustrates the opening characteristics of the winch control valve 25. The solid line L2in represents the relationship between the meter-in opening surface area and the stroke amount of the winch control valve 25. The dashed line L2out represents the relationship between the meter-out opening surface area and the stroke amount of the warm-up control valve 20.

The "stroke amount" in FIGS. 4 and 5 refers to the stroke amount from the stroke end of the closed side of the spools of the control valves. Specifically, the stroke amount at "0" indicates that the spool is positioned at the stroke and of the closed side. The maximum stroke amount Smax1 of the warm-up control valve 20 illustrated in FIG. 4 is substantially the same as the maximum stroke amount Smax2 of the winch control valve 25 illustrated in FIG. 5. However, the scale of the vertical axes in FIGS. 4 and 5 is not necessarily the same and the positions on the vertical axis in FIGS. 4 and 5 does not necessarily represent the size of the opening surface areas of the warm-up control valve 20 and the opening surface area of the winch control valve 25.

As illustrated with the solid line L1out in FIG. 4, the stroke amount of the warm-up control valve 20 is S1 when the meter-out opening 20*a* of the warm-up control valve 20 is fully closed, that is "0". The warm-up control valve 20 has opening characteristics in which the meter-out opening surface area increases as the stroke amount increases from S1 towards Smax1. The surface area of the meter-out opening 20*a* of the warm-up control valve 20 is maximized when the stroke amount of the warm-up control valve 20 reaches Smax1. Specifically, the meter-out opening surface area of the warm-up control valve 20 is maximized when the stroke position of the warm-up control valve 20 reaches the stroke end of the open side. The meter-out opening characteristics of the warm-up control valve 20 have an inflection point Pinf. The meter-out opening characteristics of the warm-up control valve 20 have a curved shape in which the rate of change of the opening surface area increases from the inflection point Pinf on the open side.

As illustrated with the dashed line L1in in FIG. 4, the warm-up control valve 20 has opening characteristics in which the meter-in opening surface area increases as the stroke amount increases from S1 towards Smax1. However, the meter-in opening surface area of the warm-up control valve 20 reaches the maximum at S1' having a stroke amount smaller than that of Smax1. S1' is larger than S1.

As illustrated with solid line L2in in FIG. 5, the stroke amount of the winch control valve 25 is S2 when the meter-in opening 25*a* of the winch control valve 25 is fully closed, that is "0". The winch control valve 25 has opening characteristics in which the meter-in opening surface area increases as the stroke amount increases from S2 towards Smax2. The surface area of the meter-in opening 25*a* of the winch control valve 25 reaches the maximum when the stroke amount of the winch control valve 25 reaches Smax2. Specifically, the meter-in opening surface area of the winch control valve 25 is maximized when the stroke position of the winch control valve 25 reaches the stroke end of the open side.

As illustrated with the dashed line L2 out in FIG. 5, the warm-up control valve 20 has opening characteristics in which the meter-out opening surface area increases as the stroke amount increases from 0 towards Smax2. However, the meter-out opening surface area of the warm-up control valve 20 is maximized at S2' which has a stroke amount smaller than Smax2. S2' is greater than S1.

As illustrated in FIGS. 4 and 5, the stroke amount S1 of the warm-up control valve 20 when the meter-out opening 20*a* of the warm-up control valve 20 is fully closed is larger than the stroke amount S2 of the winch control valve 25 when the meter-in opening 25*a* of the winch control valve 25 is fully closed.

As illustrated in FIG. 4, Smax1−S1 is less than S1. Specifically, the stroke position of the spool of the warm-up control valve 20 when the meter-out opening 20*a* of the warm-up control valve 20 is fully closed is nearer the stroke end (stroke amount=Smax1) of the open side than the stroke end (stroke amount=0) of the closed side.

As illustrated in FIG. 5, Smax2−S2 is greater than S2. Specifically, the stroke position of the spool of the winch control valve 25 when the meter-in opening 25*a* of the winch control valve 25 is fully closed is nearer the stroke end (stroke amount=0) of the closed side than the stroke end (stroke amount=Smax2) of the open side.

The pipelayer according to the present embodiment has the following features.

The stroke amount S1 of the warm-up control valve 20 when the meter-out opening 20*a* of the warm-up control valve 20 is fully closed is larger than the stroke amount S2 of the winch control valve 25 when the meter-in opening 25*a* of the winch control valve 25 is fully closed. In other words, the stroke amount (Smax1−S1) from when the meter-out opening 20*a* of the warm-up control valve 20 is fully open until the same is fully closed is smaller than the stroke amount (Smax2−S2) from when the meter-in opening 25*a* of the winch control valve 25 is fully open until the same is fully closed. Therefore, the stroke amount from when the meter-out opening 20*a* of the warm-up control valve 20 is fully open until the same is fully closed is small in comparison to when the meter-out opening characteristics of the warm-up control valve 20 are set to be the same as the meter-in opening characteristics of the winch control valve 25.

Figure 6:
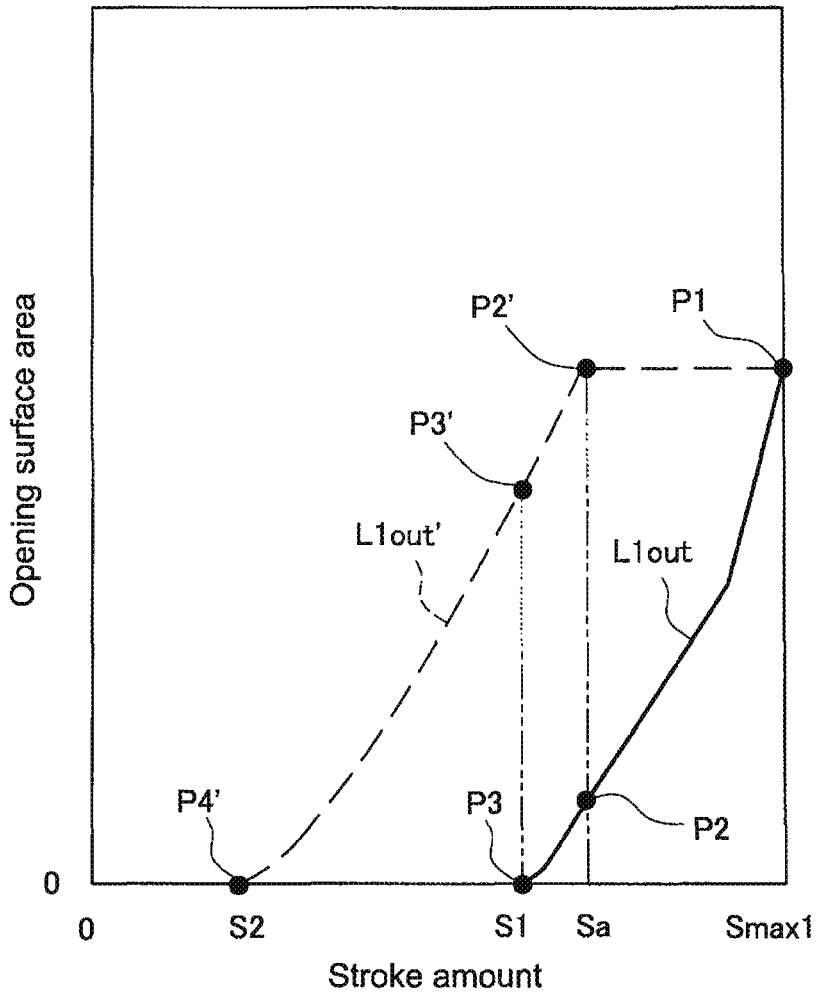
FIG. 6 illustrates opening characteristics of a warm-up control valve according to the present embodiment and of a warm-up control valve according to a comparative example.

For example, the dashed line L1out' in FIG. 6 represents the meter-out opening characteristics of the warm-up control valve according to a hypothetical comparative example. The meter-out opening characteristics of the warm-up control valve according to the comparative example are set to be the same as the winch control valve 25 meter-in opening characteristics. Specifically, the stroke amount in the meter-out opening characteristics of the warm-up control valve according to the comparative example when the meter-out opening 20*a* is fully closed, that is "0", is S2 which is the same as the winch control valve 25 meter-in opening characteristics L2in.

The following is an explanation of changes to the opening surface area when the warm-up control valve 20 is switched from the open state w1 to the closed state w2 in FIG. 6. The spool while the warm-up control valve 20 is in the open state w1 is in the closed side stroke end position, that is, the stroke amount is Smax1. At this time, the opening surface area of the warm-up control valve 20 according to the present embodiment and the warm-up control valve according to the comparative example are both fully open (see point P1).

Next, the stroke amount decreases from Smax1 when the stroke position moves from the closed side stroke end to the open side stroke end. As illustrated by L1out, the opening surface area of the warm-up control valve 20 according to the present embodiment immediately decreases when the stroke amount decreases from Smax1. In contrast, as illustrated by L1out', the opening surface area of the warm-up control valve according to the comparative example does not decrease immediately even when the stroke amount decreases from Smax1, and the opening surface area stays at the maximum until the stroke amount reaches Sa (point P2').

When the stroke amount of the warm-up control valve according to the comparative example is smaller than Sa, the opening surface area begins to grow smaller. In contrast, as illustrated by L1out, when the stroke amount of the warm-up control valve 20 according to the present embodiment reaches Sa, the opening surface area is already half or less than half of the maximum amount (see point P2). When the stroke amount of the warm-up control valve 20 according to the present embodiment reaches S1, the opening surface area becomes 0 (see point P3). Specifically, the warm-up control valve 20 enters the closed state w2.

In contrast, when the stroke amount of the warm-up control valve according to the comparative example is S1, the opening surface area is still greater than half of the maximum value (see point P3'). When the stroke amount of the warm-up control valve according to the comparative example decreases to S2, the opening surface area becomes 0 and the warm-up control valve 20 enters the closed state w2 (see point P4').

As described above, the meter-out opening 20*a* of the warm-up control valve 20 according to the present embodiment is switched from fully open to fully closed when the stroke amount is smaller than that of the warm-up control valve according to the comparative example. As a result, even if the hydraulic fluid drained from the pilot ports of the warm-up control valve 20 has a low temperature, the warm-up control valve 20 can quickly be switched from the open state w1 to the closed state w2. As a result, the period of time in which the warm-up control valve 20 and the winch control valve 25 both are in the open state can be reduced or eliminated. Consequently, the simultaneous operation of driving and warming up the winch 21 even in an extremely cold environment can be avoided in a stable manner.

The meter-out opening characteristics of the warm-up control valve 20 have an inflection point Pinf. In this case, the meter-out opening 20*a* can be switched from fully open to fully closed with a shorter stroke amount than when there is no inflection point Pinf.

Although an embodiment of the present invention has been described so far, the present invention is not limited to the above embodiments and various modifications may be made within the scope of the invention.

For example, the hydraulic circuit of the hydraulic drive system is not limited to that described above and an equivalent hydraulic circuit may be used. The forms of the above-mentioned operating components are not limited to a lever and a switch and other forms may be adopted.

While the throttle 33 is used as a pressure loss portion for heating in the above embodiment, a relief valve set to a certain relief pressure may also be used.

Although a hydraulic drive system was described for driving and for warming up the hydraulic motor 24 of the boom 4 in the abovementioned embodiment, the present invention may also be applicable to a hydraulic drive system for driving and warming up the hydraulic motor 24 for the hook 5. In this case, the hydraulic drive system for driving and warming up the hydraulic motor 24 for the hook 5 has the same configuration as the hydraulic drive system for driving and warming up the hydraulic motor 24 for the boom 4.

According to the present invention, a pipelayer is provided that is capable of avoiding in a stable manner the simultaneous operation of driving and warming up the winch even in an extremely cold environment.

What is claimed is:

1. A pipelayer comprising:

an engine;

a hydraulic pump driven by the engine;

a hydraulic motor driven by hydraulic fluid discharged from the hydraulic pump;

a winch driven by the hydraulic motor;

a pump hydraulic circuit through which the hydraulic fluid discharged from the hydraulic pump passes;

a drive hydraulic circuit connected to the hydraulic motor and through which hydraulic fluid for driving the hydraulic motor passes;

a warm-up hydraulic circuit connected to the hydraulic motor and through which hydraulic fluid for warming up the hydraulic motor passes;

a winch control valve provided between the pump hydraulic circuit and the drive hydraulic circuit, the winch control valve allowing communication between the pump hydraulic circuit and the drive hydraulic circuit in an open state, and the winch control valve shutting off communication between the pump hydraulic circuit and the drive hydraulic circuit in a closed state, the winch control valve having a meter-in opening arranged to communicate hydraulic fluid from the pump hydraulic circuit to the drive hydraulic circuit in the open state of the winch control valve, the winch control valve having a spool configured and arranged to be moved between an open-side stroke end and a closed-side stroke end of the winch control valve with a fully-closed stroke position where the meter-in opening becomes fully closed being located between the open-side stroke end and the closed-side stroke end;

a warm-up control valve provided between the pump hydraulic circuit and the warm-up hydraulic circuit, the warm-up control valve allowing communication between the pump hydraulic circuit and the warm-up hydraulic circuit in an open state, and the warm-up control valve shutting off communication between the pump hydraulic circuit and the warm-up hydraulic circuit in a closed state, the warm-up control valve having a meter-out opening arranged to communicate hydraulic fluid from the warm-up hydraulic circuit to a drain circuit in the open state of the warm-up control valve, the warm-up control valve having a spool configured and arranged to be moved between an open-side stroke end and a closed-side stroke end of the warm-up control valve with a fully-closed stroke position where the meter-out opening becomes fully closed being located between the open-side stroke end and the closed-side stroke end; and a pilot pressure control unit configured to supply hydraulic fluid to a pilot port of the warm-up control valve so that the warm-up control valve enters the open state when the winch control valve is in the closed state, and the pilot pressure control unit being configured to drain hydraulic fluid from the pilot port of the warm-up control valve so that the warm-up control valve enters the closed state when the winch control valve is in the open state, a maximum stroke amount from the closed-side stroke end to the open-side stroke end of the winch control valve being substantially equal to a maximum stroke amount from the closed-side stroke end to the open-side stroke end of the warm-up control valve, a stroke amount from the closed-side stroke end to the fully-closed stroke position of the warm-up control valve being greater than a stroke amount from the closed-side stroke end to the fully-closed stroke position of the winch control valve.

2. The pipelayer according to claim 1, wherein the fully-closed stroke position of the winch control valve is nearer the closed-side stroke end of the winch control valve than the open-side stroke end of the winch control valve; and the fully-closed stroke position of the warm-up control valve is nearer the open-side stroke end of the warm-up control valve than the closed-side stroke end of the warm-up control valve.

3. The pipelayer according to claim 2, wherein a surface area of the meter-out opening of the warm-up control valve is maximized when the stroke position of the spool of the warm-up control valve reaches the open-side stroke end of the warm-up control valve.

4. The pipelayer according to claim 3, wherein the warm-up control valve is configured to have a meter-out opening characteristic defining the surface area of the meter-out opening with respect to the stroke amount of the spool of the warm-up control valve, the meter-out opening characteristic having an inflection point.

5. The pipelayer according to claim 2, wherein the warm-up control valve is configured to have a meter-out opening characteristic defining the surface area of the meter-out opening with respect to the stroke amount of the spool of the warm-up control valve, the meter-out opening characteristic having an inflection point.

6. The pipelayer according to claim 1, wherein a surface area of the meter-out opening of the warm-up control valve is maximized when the stroke position of the spool of the warm-up control valve reaches the open-side stroke end of the warm-up control valve.

7. The pipelayer according to claim 6, wherein the warm-up control valve is configured to have a meter-out opening characteristic defining the surface area of the meter-out opening with respect to the stroke amount of the spool of the warm-up control valve, the meter-out opening characteristic having an inflection point.

8. The pipelayer according to claim 1, wherein the warm-up control valve is configured to have a meter-out opening characteristic defining a surface area of the meter-out opening with respect to the stroke amount of the spool of the warm-up control valve, the meter-out opening characteristic having an inflection point.

* * * * *